US006308652B1

(12) United States Patent
O'Neill

(10) Patent No.: US 6,308,652 B1
(45) Date of Patent: Oct. 30, 2001

(54) BOAT RAMP ASSEMBLY

(75) Inventor: C. Brian O'Neill, North Baltimore, OH (US)

(73) Assignee: S & B Manufacturing, Inc., Findlay, OH (US)

( * ) Notice: Subject to any disclaimer, the term of this patent is extended or adjusted under 35 U.S.C. 154(b) by 0 days.

(21) Appl. No.: 09/569,282

(22) Filed: May 12, 2000

Related U.S. Application Data

(60) Provisional application No. 60/135,893, filed on May 26, 1999.

(51) Int. Cl.[7] ..... B63B 35/00
(52) U.S. Cl. ..... 114/263; 401/1; 401/220
(58) Field of Search ..... 114/263; 405/1, 405/219, 220; 14/71.3

(56) References Cited

U.S. PATENT DOCUMENTS 3,004,391 * 10/1961 Miller ..... 114/263
3,227,292 * 1/1966 Jacobs .
4,505,619 * 3/1985 Sargent ..... 405/220
4,838,735 * 6/1989 Warner ..... 405/220

OTHER PUBLICATIONS

Popular Mechanics, May 1956, p. 107.*

* cited by examiner

*Primary Examiner*—Sherman Basinger
(74) *Attorney, Agent, or Firm*—Emch, Schaffer, Schaub & Porcello, Co., L.P.A.

(57) ABSTRACT

A boat ramp assembly is disclosed. The boat ramp assembly includes a rectangular frame, a metal support mounted adjacent the top of the frame. A connector pivotally mounts the frame to a shore support. In another embodiment a floating dock assembly is positioned adjacent the rectangular frame. The floating dock assembly includes a main floating dock portion, an intermediate parallel arm section and a shore mount assembly.

9 Claims, 4 Drawing Sheets

BOAT RAMP ASSEMBLY

RELATED APPLICATION

The present application is related to Provisional Application Ser. No. 60/135,893 filed May 26, 1999.

BACKGROUND OF THE INVENTION

The present invention is directed to a boat ramp assembly for marine applications. In one embodiment, the boat ramp assembly includes a floating dock assembly. In many prior boat ramps, the ramp was constructed of concrete. In these prior art boat ramps, this required that a cofferdam be built to hold back the water while excavating the earth at the ramp location. The cofferdam was also normally required to hold back the water while pouring the concrete and during the initial curing of the concrete. It was not unusual for the cost of a prior art cofferdam concrete ramp construction to be in the neighborhood of $500,000.

It was also known in the prior art to construct a dock adjacent the concrete boat ramp. Normally such a dock extends perpendicular to the shoreline adjacent the boat ramp.

SUMMARY OF THE INVENTION

The present invention is directed to a boat ramp assembly for use at, for example, a marina. The boat ramp assembly includes a rectangular frame having opposed first and second ends and a top and bottom. An metal support surface, which normally comprises a plurality of metal sections, is mounted adjacent the top of the rectangular frame.

The metal support forms the upper bearing surface of the boat ramp.

A shore support is positioned adjacent the first end of the rectangular frame. The shore support includes a peripheral frame which is held in place by stone, rocks or concrete. A mounting connector is positioned between the first end of the rectangular frame and the shore support.

In one embodiment, the boat ramp assembly includes a floating dock assembly which is positioned adjacent the rectangular frame. The floating dock assembly includes a main floating dock portion, an intermediate parallel arm section and a shore mount assembly. The main floating deck assembly includes a plurality of support floats and a rectangular dock mounted on the floats. The intermediate parallel arm section includes parallel arms pivotally mounted between the main floating dock assembly and the shore mount assembly. At least one cylinder is operatively connected between the shore mount assembly and the intermediate parallel arm section.

DETAILED DESCRIPTION OF THE PREFERRED EMBODIMENTS

Figure 1:
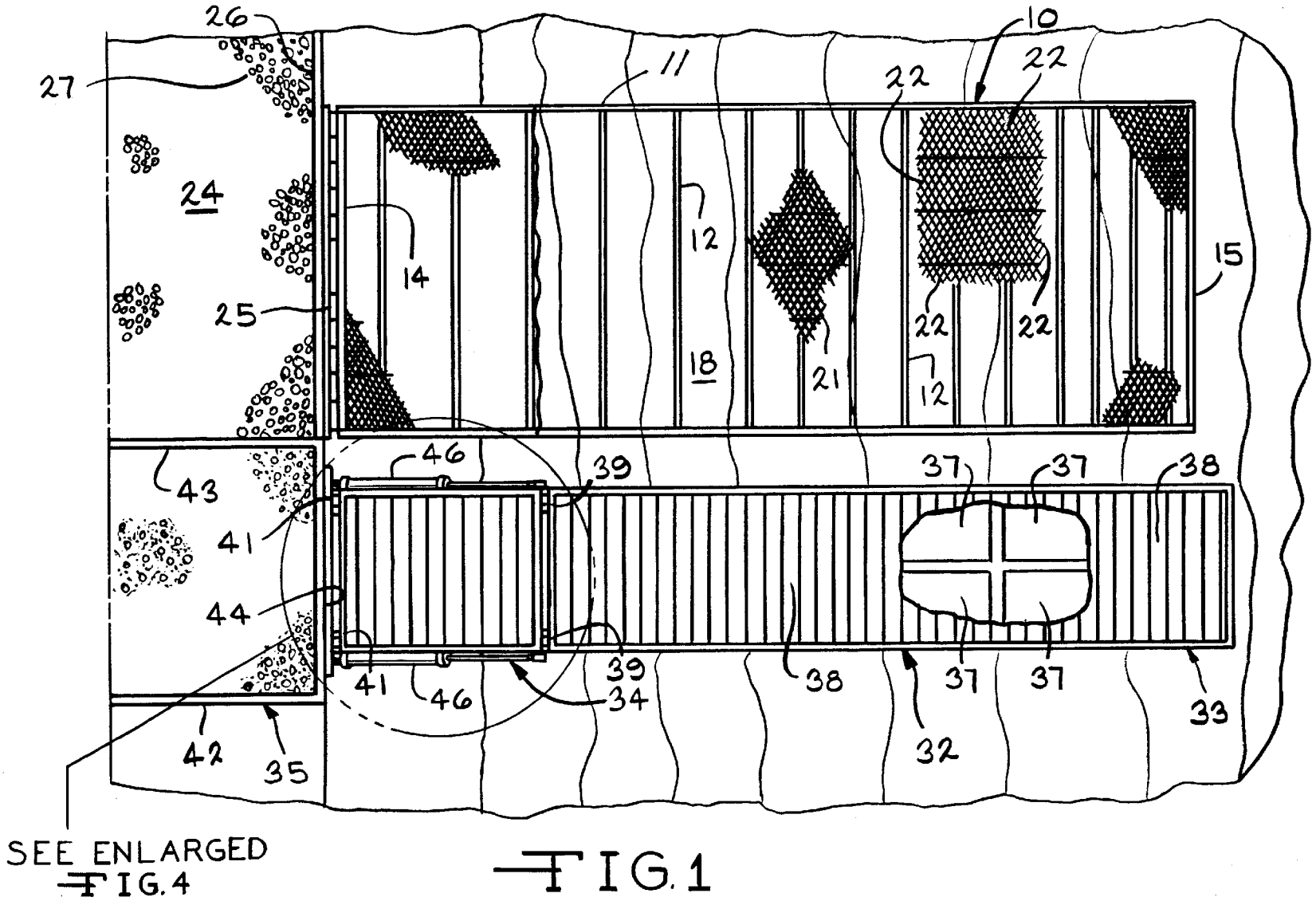
FIG. 1 is plan view showing a boat ramp assembly, according to the present invention, with parts removed to show underlying elements.

A boat ramp assembly, according to the present invention is generally indicated by the reference number 10. The boat ramp assembly 10 includes a rectangular metal frame 11 having a plurality of intermediate supports 12. The metal frame 11 includes a first end 14 and a second opposed end 15.

Figure 2:
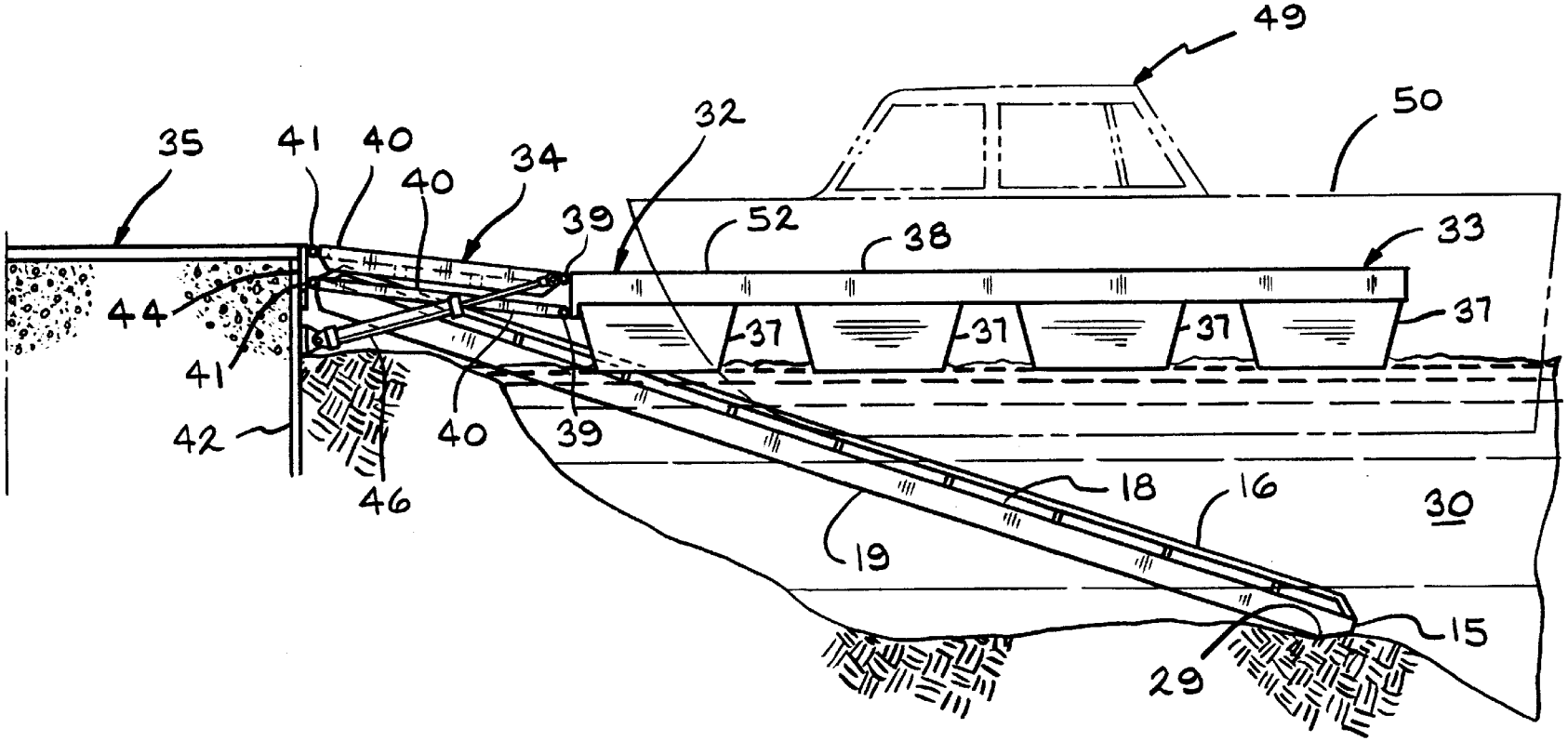
FIG. 2 is a side elevational view of the boat ramp assembly, with a boat shown in dashed lines.
Figure 3:
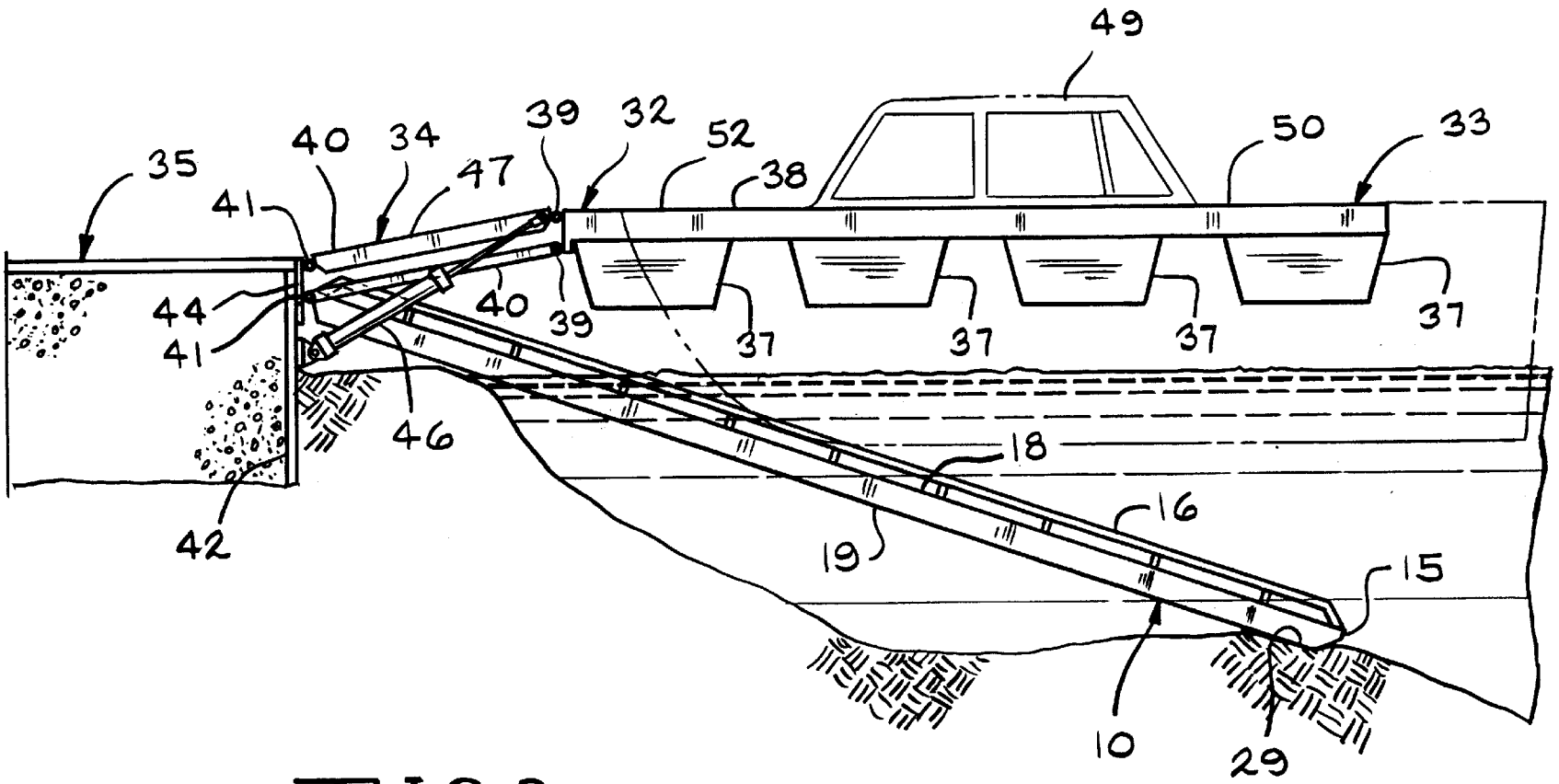
FIG. 3 is a view similar to FIG. 2 showing the rectangular dock in an elevated position;.
Figure 4:
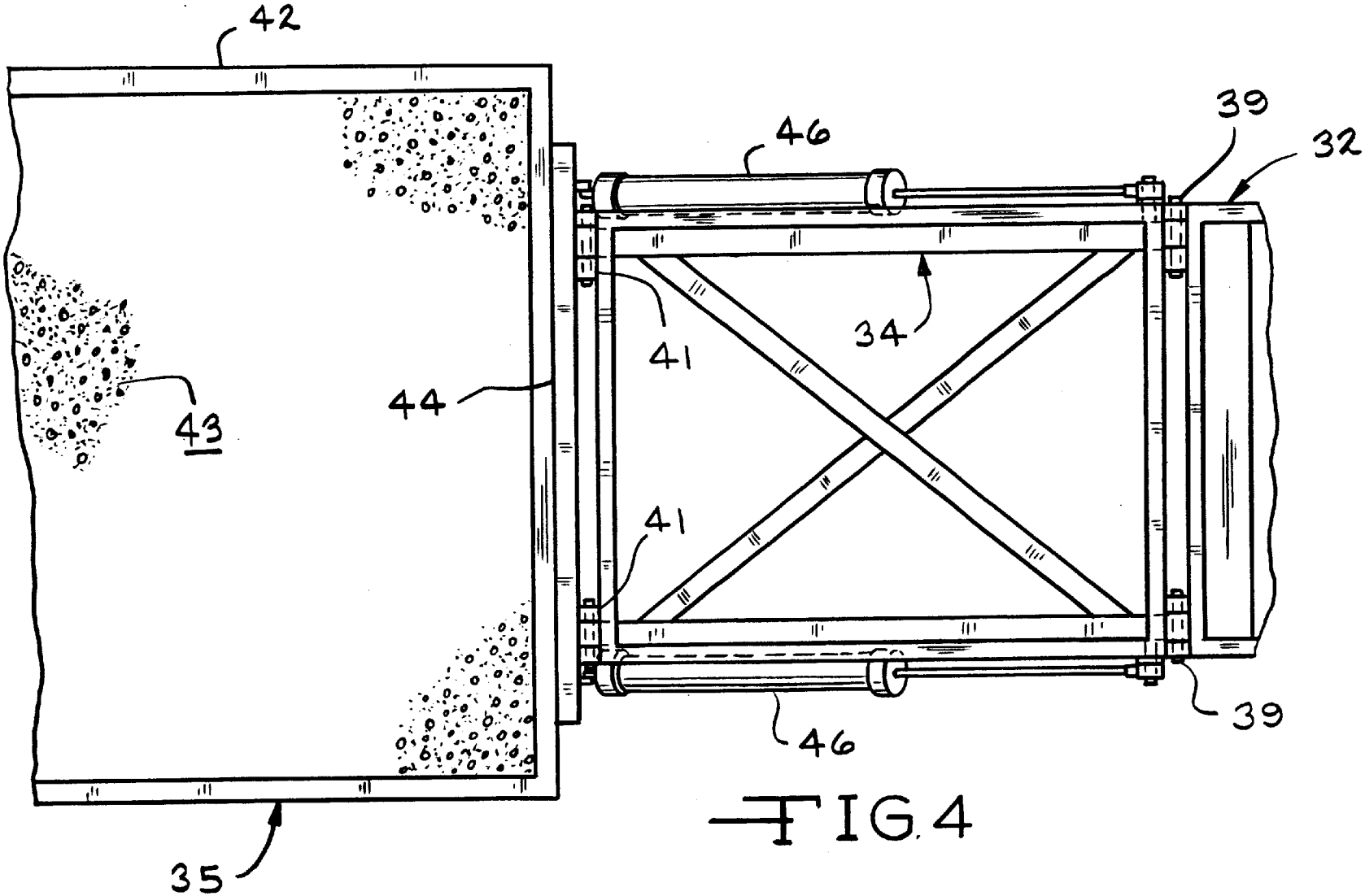
FIG. 4 is an enlarged plan view of a portion of FIG. 1.

Referring to FIGS. 2 and 3, side rails 16 extend upwardly from the metal frame 11. The metal frame 11 includes a top 18 and a bottom 19. A metal support 21 forms the upper bearing surface of the boat ramp assembly 10. In the present embodiment, the metal support 21 comprises a plurality of longitudinally extending metal support sections 22, as indicated in FIG. 1. A shore support 24 is positioned on the shore and is pivotally joined by a connector 25 to the first end 14 of the rectangular metal frame 11. In the present embodiment, the shore support 24 includes a metal shore frame 26 which receives concrete 27. In other embodiments, rocks or stones are used rather than concrete. In the present embodiment, the connector 25 comprises a piano hinge which is connected between the shore frame 26 of the shore support 24 and the first end 14 of the rectangular metal frame 11.

The metal frame 11 pivots on the piano hinge connector 25 until the second end 15 engages the bottom 29 of the body of water 30. The second end 15 of the rectangular metal frame 11 is vertically moveable.

While the boat ramp assembly 10 is often constructed without an adjacent dock, in an embodiment shown in FIG. 1, the boat ramp assembly 10 includes a floating dock assembly 32 positioned adjacent the rectangular metal frame 11. The floating dock assembly 32 includes a main floating dock portion 33, an intermediate parallel arm section 34 and a shore mount assembly 35.

The main floating dock portion 33 includes a plurality of floats 37 positioned below the horizontal surface deck 38 of the main floating deck portion 33.

Cooperating hinges 39 pivotally connect the intermediate parallel arm section 34 to the main floating dock portion 33. Sets of parallel arms 40 are pivotally connected on each side of the intermediate parallel arm section 34. The other ends of the parallel arms 40 are pivotally connected mounted to the shore mount assembly 35. Hinges 41 join the intermediate parallel arm section 34 to the shore mount assembly 35. The intermediate parallel arm section 34 includes a decking layer 47.

In the present embodiment, the shore mount assembly 35 includes a metal frame 42 which is filled with concrete 43. A plate 44 (see FIG. 1) is welded to the frame 42 and mounts the hinges 41. The hinges in turn are pivotally connected to the sets of parallel arms 40. Cylinders 46 are operatively connected between the shore mount assembly 35 and the intermediate parallel arm section. Extension or retraction of the cylinders 46 raise and lower the floating dock portion 33, while the parallel arms 40 maintain the floating dock portion in a horizontal position.

Referring to FIG. 2, a boat 49 having a loading surface 50 is shown adjacent the main floating dock portion 33 of the floating dock assembly 32. As shown in FIG. 3, by extending the cylinders 46, the main floating dock portion 33 may be raised to position an upper surface 52 of the dock portion 33 adjacent the loading surface 50 of the boat 49. This allows easy ingress and egress of passengers from the boat 49, particularly handicapped persons.

Many revisions to the above described invention, may be made without departing from the scope of the invention or from the following claims.

I claim:

1. A boat ramp assembly comprising a rectangular frame having opposed first and second ends and a top and bottom, a metal support mounted adjacent said top of said frame, said metal support forming the upper bearing surface of said boat ramp, a horizontal mounting connector on said first end of said rectangular frame, and a fixed shore support adjacent said first end of said rectangular frame, said mounting connector joining said shore support to said rectangular frame said shore support being fixed to the shore by rocks or concrete.

2. A boat ramp assembly, according to claim 1 wherein said mounting connector compress a longitudinally extending piano hinge assembly, and wherein said second end of said rectangular frame is vertically movable.

3. A boat ramp assembly according to claim 1, wherein said metal support comprises a plurality of longitudinally extending support sections.

4. A boat ramp assembly, according to claim 1 wherein said shore support comprises a shore frame, which receives said concrete or foundation rock, for pivotally securing the boat ramp to the shore, said horizontal mounting connector being attached to said shore frame.

5. A boat ramp assembly, according to claim 1, including a floating dock assembly positioned adjacent said rectangular frame, said floating dock assembly including a main floating dock portion, an intermediate parallel arm section and a shore mount assembly.

6. A boat ramp assembly, according to claim 5, wherein said main floating dock portion includes a plurality of floats and a rectangular dock mounted on said floats, parallel arms pivotally mounted between said main floating dock portion and said shore mount assembly, at least one power cylinder operatively connected to said shore mount assembly and said intermediate parallel arm section, and a horizontal connector assembly between said intermediate parallel arm section and said shore mount assembly, whereby activation of said power cylinder raises or lowers said main floating dock portion.

7. A boat ramp assembly, according to claim 6, wherein said intermediate parallel arm section includes a decking layer positioned over said parallel arms.

8. A floating dock assembly, comprising a main floating dock portion, an intermediate parallel arm section and a shore mount assembly, a plurality of floats and a rectangular dock mounted on said floats, said intermediate parallel arm section including parallel arms pivotally mounted between said main floating dock portion and said shore mounted assembly, at least one power cylinder operatively connected between said shore mount assembly and said intermediate parallel arm section, a first connector assembly between said intermediate parallel arm section and said shore mount assembly and a second connector assembly between said main floating dock portion and said intermediate parallel arm section, whereby activation of said power cylinder raises or lowers said main floating dock assembly.

9. A floating deck assembly, according to claim 8, wherein said intermediate parallel arm section includes a decking layer positioned over said parallel arms.

* * * * *

UNITED STATES PATENT AND TRADEMARK OFFICE

CERTIFICATE OF CORRECTION

PATENT NO. : 6,308,652 B1
DATED : October 30, 2001
INVENTOR(S) : C. Brian O'Neill It is certified that error appears in the above-identified patent and that said Letters Patent is hereby corrected as shown below:

Claim 2,
Line 10, delete "compress" and insert -- comprises --.

Signed and Sealed this

Twelfth Day of March, 2002

*Attest:*

*Attesting Officer*

JAMES E. ROGAN
*Director of the United States Patent and Trademark Office*